US006449995B1

(12) United States Patent
Paolini et al.

(10) Patent No.: US 6,449,995 B1
(45) Date of Patent: Sep. 17, 2002

(54) AUTOMATIC DEADBOLT

(75) Inventors: Michael A. Paolini, Round Rock; Viktors Berstis, Austin, both of TX (US)

(73) Assignee: International Business Machines Corp., Armonk, NY (US)

( * ) Notice: Subject to any disclaimer, the term of this patent is extended or adjusted under 35 U.S.C. 154(b) by 0 days.

(21) Appl. No.: 09/522,197

(22) Filed: Mar. 9, 2000

(51) Int. Cl.[7] ..... E05B 43/00
(52) U.S. Cl. ..... 70/267; 70/124; 70/150
(58) Field of Search ..... 70/267, 266, 268, 70/269, 270, 124, 129, 134, 150

(56) References Cited

U.S. PATENT DOCUMENTS

| | | | | | |
|---|---|---|---|---|---|
| 1,105,286 | A | | 7/1914 | Mieth | |
| 1,764,154 | A | | 6/1930 | Cramer | |
| 3,677,043 | A | | 7/1972 | Cox | |
| 4,269,050 | A | * | 5/1981 | Bechtiger et al. | 70/272 |
| 4,369,641 | A | * | 1/1983 | Wallach | 70/272 |
| 4,640,110 | A | | 2/1987 | Fish et al. | |
| 4,643,106 | A | | 2/1987 | Aragona | |
| 4,821,541 | A | * | 4/1989 | Richard et al. | 70/272 |
| 4,843,851 | A | * | 7/1989 | Frolov | 70/277 |
| 4,944,170 | A | * | 7/1990 | Jolidon et al. | 70/267 |
| 5,422,634 | A | * | 6/1995 | Okubo | 340/825.34 |
| 5,660,064 | A | * | 8/1997 | Ecker et al. | 70/16 |
| 5,862,692 | A | * | 1/1999 | Legault et al. | 70/303 A |
| 5,933,085 | A | * | 8/1999 | Holcomb et al. | |
| 5,933,086 | A | * | 8/1999 | Tischendorf et al. | |
| 5,986,564 | A | * | 11/1999 | Fraser | 340/825.32 |
| 6,032,499 | A | * | 3/2000 | Juillerat et al. | 70/267 |

* cited by examiner

*Primary Examiner*—William A. Cuchlinski, Jr.
*Assistant Examiner*—Olga Hernandez
(74) *Attorney, Agent, or Firm*—Kevin L. Daffer; Conley, Rose & Tayon P.C.; Marilyn S. Dawkins, IBM

(57) ABSTRACT

An automatic locking mechanism engages a deadbolt lock after a prescribed time interval following entry. The mechanism employs a spring-operated mechanical timer, which may be actuated when a key or thumbturn is turned to unlock the door, and avoids the need for a key to set the deadbolt. The mechanism includes a gear system for retracting and inserting the deadbolt and a mechanical restraint to withhold the deadbolt until the timer has expired. In a suggested embodiment, a cam attached to one of the timer gears removes the restraint when the timer runs down. This deploys the deadbolt, automatically locking the door. In another embodiment, automatic locking may optionally be disabled by inhibiting coupling between the gear system and the timer spring.

22 Claims, 3 Drawing Sheets

AUTOMATIC DEADBOLT

BACKGROUND OF THE INVENTION

1. Field of the Invention

This invention is related to the field of lock mechanisms and, more particularly, to automatic lock mechanisms.

2. Description of the Related Art

Security is an increasingly important concern for both home and business. Despite the existence of numerous types of alarms and electronic security systems, the primary barrier to unauthorized entry in most cases is a locked door, and an important factor contributing to an overall level of security is the impregnability of the lock.

Furthermore, in situations calling for frequent entry and egress, such as a home, convenience is also an important consideration. No matter what advantages a lock may offer, if it is overly complicated or requires a great deal of effort to operate, people will tend to avoid using it. Users often deliberately circumvent elaborate, but inconvenient, security systems.

It is well known that deadbolt lock mechanisms provide greater security and are more resistant to unauthorized entry than conventional doorknob key locks. Unfortunately, standard deadbolt mechanisms lack the convenience of key locks, and therefore, are less frequently used than they might otherwise be. While the majority of doorknob key locks can be set to automatically lock the door when it is closed, a deadbolt lock typically must be locked from the outside with a key. Upon leaving a building, an additional step is therefore required to secure it with a deadbolt lock, compared with the automatic locking feature of the doorknob key lock. This may be sufficient encouragement for people to forego the greater security of the deadbolt. An automatic mechanism that engages a deadbolt without the need for a key would add greatly to the convenience of the deadbolt lock. This, in turn, would conduce to wider use of the deadbolt lock, and enhanced security.

Previous approaches to automatic locking mechanisms suffer from a variety of drawbacks. Many of these designs employ electronic timers or actuators. For example, U.S. Pat. No. 3,677,043 to Cox describes an electrically-actuated remote control door lock. Electronic timers are capable of great precision and longevity, and they can be readily integrated with other intrinsic circuitry, e.g., as in an electronic combination lock. However, in the event of power loss such mechanisms may become ineffective. In the worst case, this could mean leaving a door unsecured, or on the other hand, locking out individuals with rightful access. Other approaches to automatic locking make use of pneumatic timing devices. For example, U.S. Pat. No. 4,643,106 to Aragona describes a method for automatically relocking a lock after a prescribed time delay, in which the time delay depends on the compression of air by a piston and cylinder. There are problems with such designs, however. The seals in dashpots and similar devices are prone to wear and subject to temperature changes, which may result in substantial variation in the timing characteristics.

SUMMARY OF THE INVENTION

The problems outlined above are in large part solved by an automatic deadbolt locking mechanism as described herein. The mechanism comprises a deadbolt lock with means for automatically engaging the lock, along with a mechanical timer. The mechanical timer may comprise a system of gears and a coil spring. When the key, or a thumbturn, is turned to unlock the door, the primary gear within the system of gears may be made to rotate, winding the spring and simultaneously compelling the other gears to rotate at a rate determined by their relative gear ratios. The speed at which the primary gear rotates may be determined, for example, by a small propeller or centrifugal weights, as are commonly employed in mechanical clocks. The time required for the spring to completely unwind and restore the gears to their initial orientations constitutes the timer interval.

The deadbolt lock further comprises a deadbolt, which may be pushed into the locked position by a compression spring. Gear teeth on the deadbolt may mesh with teeth on a drive gear, such that when the key or thumbturn is turned the deadbolt is retracted from its locked position. A catch prevents the deadbolt from returning to the locked position until the timer runs down. The catch may be disengaged by a cam on one of the timer gears that, when rotated into position, lifts the retaining catch and releases the deadbolt. Once this happens, the compression spring immediately thrusts the deadbolt into the locked position.

Thus, unlocking the door may activate the deadbolt locking mechanism. Upon this unlocking of the door, after a prescribed interval the timer may automatically reengage the deadbolt lock. Additionally, in one embodiment, a pushbutton may be included in the mechanism that enables or disables the timing mechanism. This function may be useful if it is desired to allow the door to remain unlocked for some period of time.

A method is also contemplated herein for automatically relocking a deadbolt, after a prescribed time interval subsequent to unlocking the door. This method may further comprise means for optionally disabling automatic operation, allowing the mechanism to function as a conventional deadbolt lock.

The method and mechanism described herein are believed to be advantageous by providing increased convenience when using a deadbolt lock. Deadbolt locks are known to offer greater security against unauthorized entry than doorknob locks. Automatic activation of a deadbolt is believed to increase the likelihood that the deadbolt lock will be used. A mechanical design as described herein is believed to have inherently greater reliability than other designs, such as power-dependent electronic systems, pneumatic or hydraulic systems.

BRIEF DESCRIPTION OF THE DRAWINGS

Other objects and advantages of the invention will become apparent upon reading the following detailed description and upon reference to the accompanying drawings in which.

Figure 1:
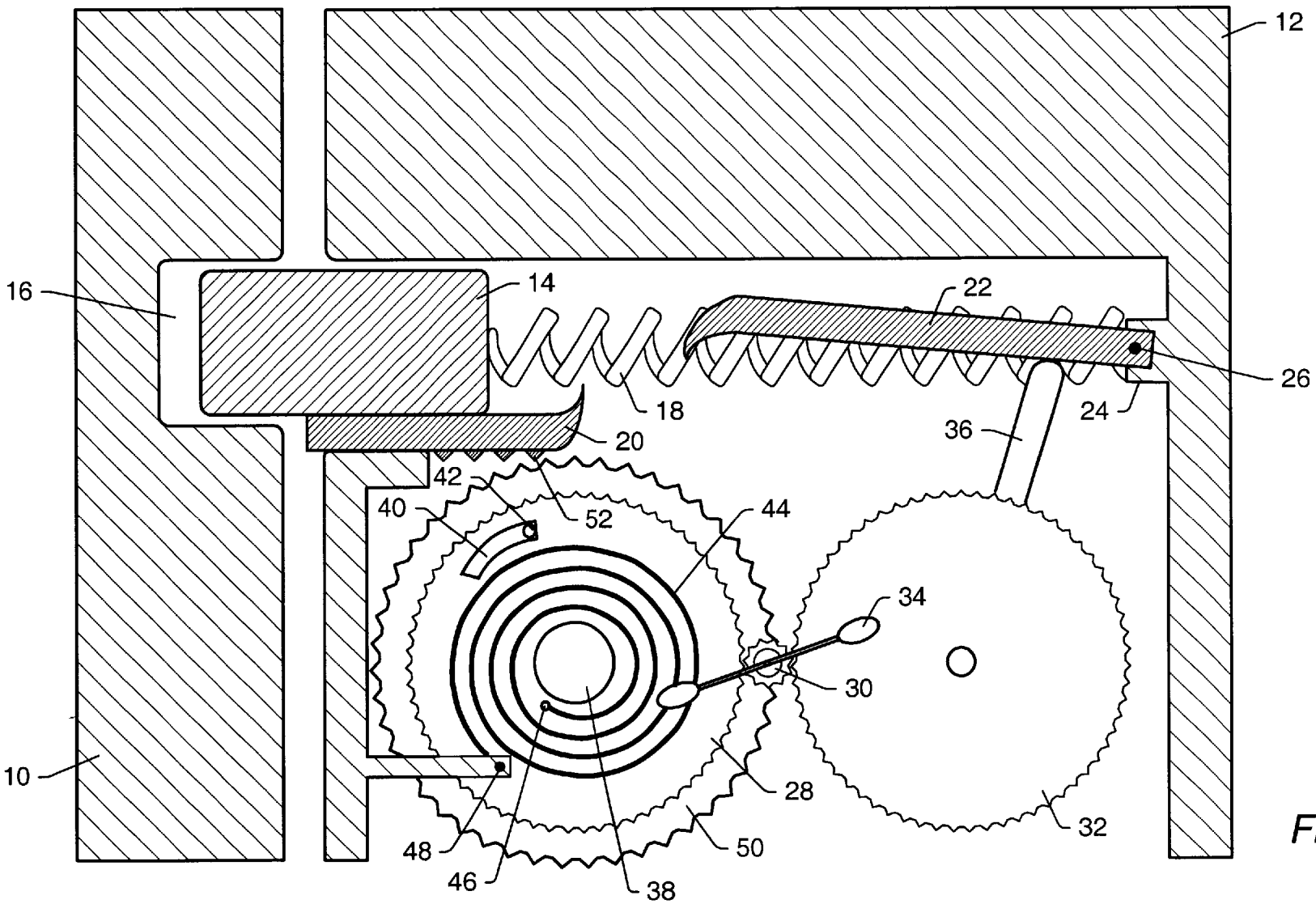
FIG. 1 is a side view of an embodiment of the automatic deadbolt locking mechanism, shown in the locked configuration.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning now to FIG. 1, a side view of one embodiment of an automatic deadbolt locking mechanism is shown. Other embodiments are possible and contemplated. The components of the lock are shown in FIG. 1 as they appear when the door is locked. For the discussion which follows, we take this to be the "initial state" of the mechanism. In this view the door is closed, with the doorjamb 10 to the left and the door 12 to the right. A recess in the doorjamb 16 is dimensioned to receive the deadbolt 14 when the door is locked, and a compression spring 18 may apply force to thrust the deadbolt 14 into the recess 16. However, the spring 18 can be prevented from thrusting deadbolt 14 into recess 16 by a pair of catches, 20 and 22. In the embodiment of FIG. 1, lower catch 20 is attached to the deadbolt 14, while upper catch 22 is attached to a fixed point 24 within the door and pivots about point 24; when the tip of lower catch 20 engages the tip of upper catch 22 the deadbolt is held in place.

The mechanism may also comprise a system of gears 28, 30, and 32, which are mutually coupled and designed to turn at different rates. The primary gear 28 is coupled to a reduction gear 30 which is, in turn, coupled to secondary gear 32. The ratio of gear 28 to gear 30 is such that gear 30 rotates at a much higher rate than gear 28. Gear 32, on the other hand, rotates at a rate comparable to that of gear 28. A cam 36 attached to gear 32 may be used to lift the upper catch 22, disengaging it from the lower catch 20, as the gear rotates counterclockwise. The speed of rotation of gear 30 may be limited by means of a governor 34, consisting of one of a number of devices commonly employed for this purpose in mechanical clocks. In one embodiment, a small propeller attached to the shaft of gear 30 creates a drag force that acts against the rotation of the gear, limiting its rate of rotation. Since they are coupled to gear 30, gears 28 and 32 experience this drag force as well. Primary gear 28 turns freely on a main shaft 38 that is turned by the door key or thumbturn. A slot 40 may be formed within the primary gear 28 through which a pin 42 extends. The pin is attached to the main shaft 38 and serves to transfer rotation of the shaft to the primary gear.

Figure 2:
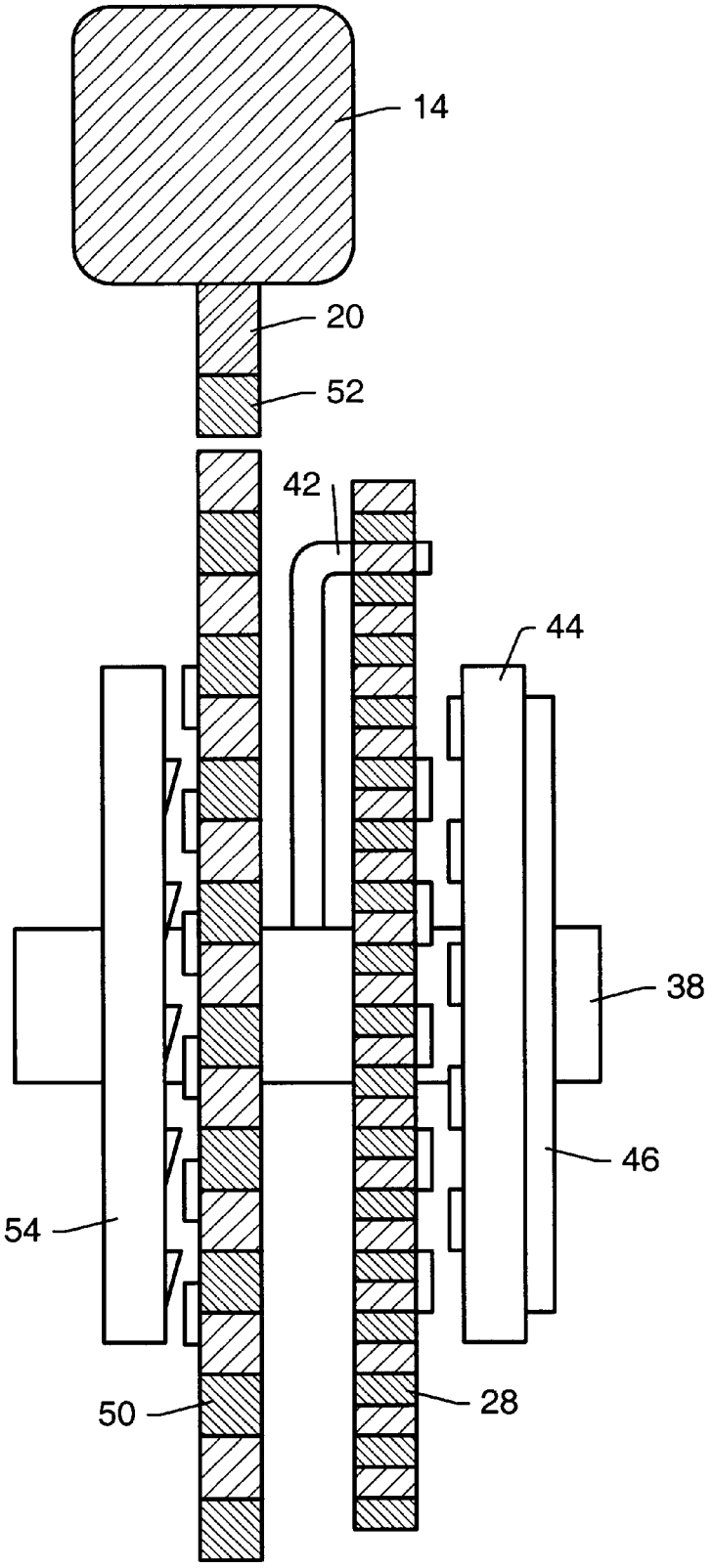
FIG. 2 is a front view of the automatic deadbolt locking mechanism embodiment of FIG. 1.

A front view of the mechanism of FIG. 1 is shown in FIG. 2. The deadbolt 14 and the lower catch 20 are shown at the top. Turning freely on main shaft 38, and mounted directly behind primary gear 28, is drive gear 50. In this embodiment, gear teeth 52 on the lower catch 20 mesh with teeth on the drive gear 50. Therefore, when the drive gear 50 turns clockwise (viewed as in FIG. 1) the deadbolt slides out of the recess 16. The pin 42 attached to main shaft 38 is also visible in the view of FIG. 2, penetrating the slot in primary gear 28. Fixed to shaft 38 may be a clutch disk 54, which is designed to interface with the drive gear 50. Their opposing surfaces comprise a ratcheting mechanism; when clutch disk 54 rotates counterclockwise it turns independently of drive gear 50, but when rotated clockwise it is coupled to the drive gear, forcing the gear to turn with it.

Turning freely on main shaft 38 and just in front of the primary gear 28 shown in FIG. 1 may be a coupling disk 44. On the front surface of this disk may be mounted a coil spring 46, one end of which is attached to the coupling disk at point 48 and the other end of which is attached to a fixed point 56 within the door. Thus, when coupling disk 44 rotates, it winds or unwinds the coil spring. Coupling disk 44 may be thrust forward or retracted, bringing it into or out of contact with primary gear 28. This may be accomplished for example, by a pushbutton. In a preferred embodiment of the locking mechanism, the coupling disk is normally not in contact with the primary gear unless the button is pushed. The opposing surfaces of the primary gear 28 and coupling disk 44 are designed to interlock with one another when they are brought into contact with one another, such that the coupling disk and the primary gear are made to rotate together. As explained in greater detail below, automatic relocking of the deadbolt is enabled when the coupling disk 44 is in its forward position, engaging the primary gear 28. When the coupling disk is retracted, the locking mechanism functions as a conventional deadbolt lock. Note that items 16, 18–22, 28–34, 38, and 42-56 are preferably made of metal, but other suitable materials could conceivably be used. Furthermore, the shapes and spatial arrangement of the components described herein and indicated in the accompanying drawings are intended to suggest a particular embodiment which illustrates the principles underlying the automatic deadbolt locking mechanism. Other embodiments employing these principles are contemplated and should be considered within the scope of the present invention.

Figure 3:
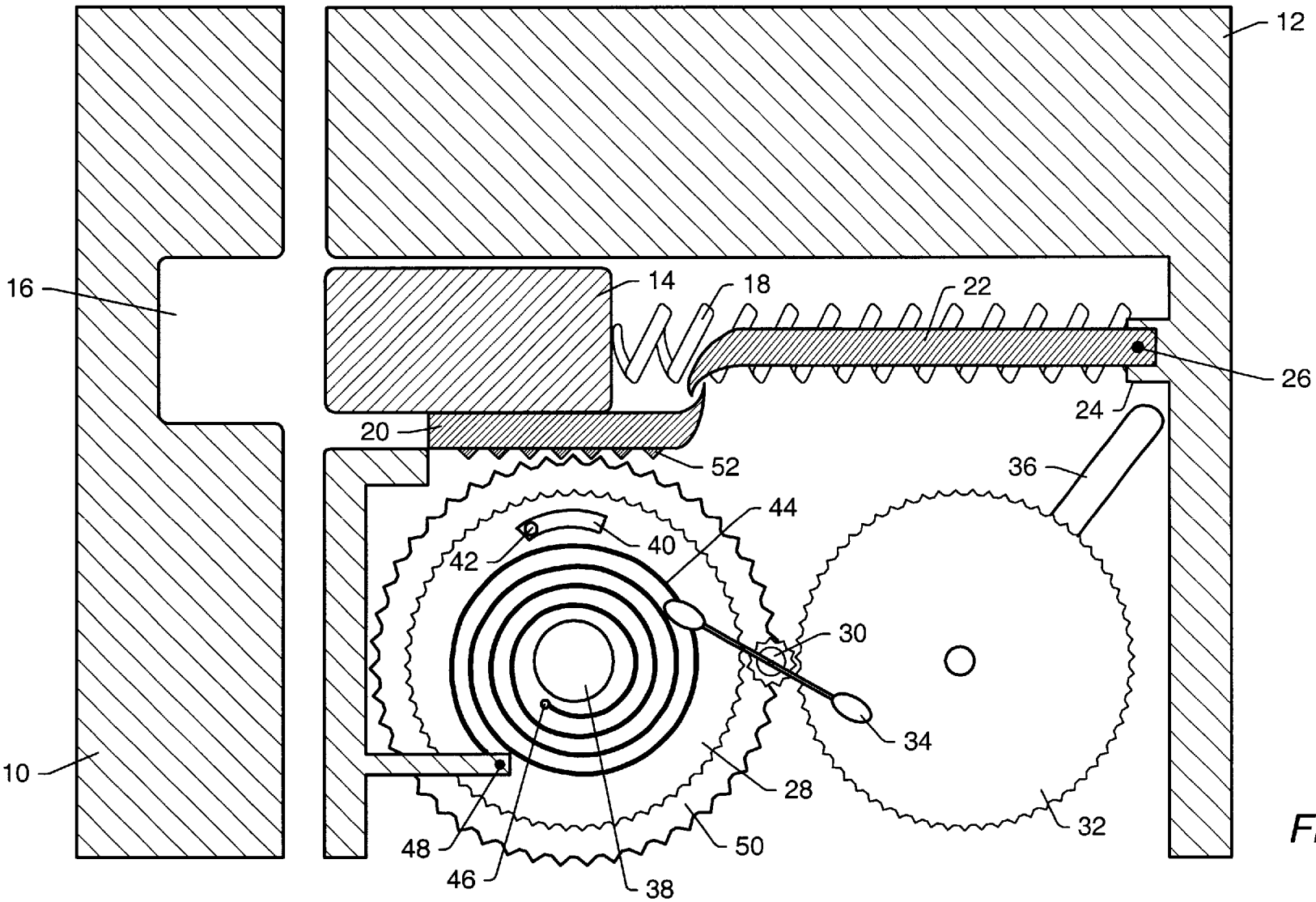
FIG. 3 is a side view of the embodiment of the automatic deadbolt locking mechanism shown in FIG. 1, where the mechanism is shown in the unlocked configuration.

Operation of the automatic deadbolt embodiment of FIGS. 1–3 may now be described. To open the door a key or thumbturn is turned in the lock, causing main shaft 38 to rotate clockwise (viewed as in FIG. 1). Because of the ratcheting action described above, as shaft 38 rotates clockwise it causes clutch disk 54 to engage drive gear 50 and force it to rotate in the same direction. As the drive gear rotates clockwise it draws the deadbolt 14 out of recess 16, unlocking the door. At the same time, pin 42 attached to shaft 38 forces primary gear 28 to rotate clockwise. Coupled secondary gear 32 rotates clockwise as well, moving cam 36 out from under the upper catch 22 and enabling the upper catch to engage the tip of lower catch 20. At this time, if coupling disk 44 is in its forward position it rotates along with primary gear 28, winding coil spring 46.

When the door has been unlocked, shaft 38 is returned to its original orientation and the key, if used, is withdrawn. At this time, the components appear as shown in FIG. 3. Note that pin 42 has returned to its original position, while slot 40 has rotated clockwise. Also note that upper catch 22 has captured lower catch 20 and prevents the compression spring from thrusting the deadbolt 14 into recess 16. At this point, the operation of the locking mechanism will depend on whether or not automatic locking is enabled.

If the coupling disk 44 was in contact with the primary gear when the door was unlocked, it will have rotated with the primary gear and wound coil spring 46. Now, as the coil spring 46 unwinds, coupling disk 44 and primary gear 28 turn counterclockwise. However, observe that while the lower and upper catches 20 and 22 are engaged, the deadbolt is prevented from entering the recess and the door remains unlocked.

As coil spring 46 continues to unwind, primary gear 28 and secondary gear 32 eventually return to their orientations as shown in FIG. 1. It is believed that their rate of rotation is a consistent and predictable function of the respective gear ratios, the characteristics of coil spring 46 and the drag force associated with governor 34. When secondary gear 32 has rotated sufficiently to lift upper catch 22 with cam 36, the tip of lower catch 20 is released. This allows compression spring 18 to thrust deadbolt 14 into recess 16, automatically locking the door.

On the other hand, if coupling disk 44 was retracted, it will not have rotated along with primary gear 28 when the door was unlocked, and coil spring 46 will not be wound. In this case, primary and secondary gears 28 and 34 will not rotate back to their original orientation when the key is withdrawn. Therefore, cam 36 will not be brought into position to disengage lower and upper catches 20 and 22, so deadbolt 14 will not be released. The door must then be relocked manually by turning the key or thumbturn counterclockwise. When this is done, counterclockwise rotation of main shaft 38 and the action of pin 42 in slot 40 will cause primary gear 28 to also rotate counterclockwise. This rotation is coupled to secondary gear 34 by reduction gear 30. As the secondary gear rotates it brings into position cam 36, lifting upper catch 22 and allowing compression spring 18 to thrust the deadbolt back into recess 16, which locks the door. Note that this mode of operation is essentially that of a conventional deadbolt lock.

It will be appreciated by those skilled in the art having the benefit of this disclosure that this invention is believed to present a system and method for implementing an automatic deadbolt locking mechanism. Further modifications and alternative embodiments of various aspects of the invention will be apparent to those skilled in the art in view of this description. Such details as the number of gears and the types of springs used in the mechanical timer described herein are exemplary of a particular embodiment. It is intended that the following claims be interpreted to embrace all such modifications and changes and, accordingly, the specification and drawings are to be regarded in an illustrative rather than a restrictive sense.

What is claimed is:

1. A method for automatically locking a door, comprising:

withholding a deadbolt for a prescribed time interval after unlocking of the door, using a mechanical timer, wherein said withholding the deadbolt comprises using a mechanical restraint to overcome the action of a spring; and automatically inserting the deadbolt into a recess to relock the door at the end of the time interval, wherein said automatically inserting the deadbolt comprises disabling the mechanical restraint, allowing the spring to thrust the deadbolt into a locked position.

2. The method as recited in claim 1, wherein said unlocking of the door comprises retracting the deadbolt.

3. The method as recited in claim 2, wherein said retracting the deadbolt comprises propelling the deadbolt by means of a rotating gear, the teeth of which mesh with gear teeth attached to the deadbolt.

4. A locking mechanism comprising:

a retractable deadbolt;

a means for retracting the deadbolt to unlock the door;

a means for withholding the deadbolt to allow the door to remain unlocked;

a mechanical timer;

a means for arming the mechanical timer; and a means for automatically engaging the deadbolt when the timer has expired, wherein said means for automatically engaging the deadbolt when the timer has expired comprises a gear-driven cam that disables the means for withholding the deadbolt.

5. The locking mechanism as recited in claim 4, wherein said retractable deadbolt comprises a deadbolt having gear teeth adapted to mesh with complementary teeth on a rotating gear, such that rotation of the gear compels the deadbolt to move laterally.

6. The locking mechanism as recited in claim 4, wherein said means for disengaging the deadbolt to unlock the door comprises a shaft rotated by a key or thumbturn, under whose influence the deadbolt is laterally displaced to an unlocked position.

7. The locking mechanism as recited in claim 4, wherein said means for withholding the deadbolt comprises a mechanical constraint that prevents the deadbolt from being laterally displaced into the locked position.

8. The locking mechanism as recited in claim 4, wherein said mechanical timer comprises a coil spring, a system of gears and a governor, such that arming the timer consists of winding the spring, and such that the governor influences the rotational speed of the gears and the interval required for the spring to unwind.

9. The locking mechanism as recited in claim 8, wherein said means for arming the mechanical timer comprises a means for coupling a rotating shaft to the coil spring, such that rotation of the shaft winds the spring.

10. The locking mechanism as recited in claim 9, wherein said means for coupling the shaft to the coil spring comprises a pair of interlocking disks, one of which is driven by the rotating shaft and the other of which is attached to the coil spring, and such that when the disks engage one another, rotation of either disk compels the other to rotate.

11. The locking mechanism as recited in claim 10, wherein operation of the mechanical timer may be optionally inhibited by preventing said interlocking disks from engaging each other.

12. A locking mechanism comprising:

a retractable deadbolt;

an actuator configured to retract the deadbolt;

a restraint configured to maintain the deadbolt in a retracted position; and a mechanical timer configured to establish an interval over which the deadbolt is maintained in the retracted position, wherein said mechanical timer comprises a system of gears, a governor and a coil spring.

13. The locking mechanism as recited in claim 12, wherein said retractable deadbolt is adapted to fit inside a recess within the doorjamb, and retracting the deadbolt comprises withdrawing the deadbolt from the recess.

14. The locking mechanism as recited in claim 13, wherein the door is locked when the deadbolt is within the recess and unlocked otherwise.

15. The locking mechanism as recited in claim 12, wherein said actuator comprises a rotating gear equipped with teeth that mesh with complementary teeth on the deadbolt, and such that rotation of the gear displaces the deadbolt.

16. The locking mechanism as recited in claim 12, wherein said restraint comprises a pair of hook-shaped catches, one of which is attached to the retractable deadbolt and the other to a fixed point, and such that the catches are adapted to interlock with one another and resist separation.

17. The locking mechanism as recited in claim 12, wherein said governor comprises a propeller in which energy is lost to air resistance when the propeller rotates.

18. The locking mechanism as recited in claim 12, wherein said governor comprises a set of weight on extensible arms, in which energy is lost to angular momentum when the arms rotate.

19. The locking mechanism as recited in claim 12, wherein said timer interval is the period required for the spring to unwind against the resistance of the gears and governor.

20. The locking mechanism as recited in claim 12, further comprising a means for coupling the gears and governor to the coil spring, such that winding or unwinding the spring causes the gears and governor to rotate.

21. The locking mechanism as recited in claim 18, wherein said means for coupling the gears and governor to the coil spring comprises a coupling disk attached to the spring, that interlocks with one of the gears when brought into contact with it.

22. The locking mechanism as recited in claim 21, wherein said mechanical timer may be disabled by retracting the coupling disk.

* * * * *

UNITED STATES PATENT AND TRADEMARK OFFICE

CERTIFICATE OF CORRECTION

PATENT NO. : 6,449,995 B1 
DATED : September 17, 2002
INVENTOR(S) : Paolini et al.

It is certified that error appears in the above-identified patent and that said Letters Patent is hereby corrected as shown below:

Column 6,
Line 48, after the phrase "comprises a set of" please delete "weight" and substitute therefor -- weights --.

Signed and Sealed this

First Day of April, 2003

JAMES E. ROGAN
*Director of the United States Patent and Trademark Office*